US008766518B2

(12) United States Patent
Panyik et al.

(10) Patent No.: US 8,766,518 B2
(45) Date of Patent: Jul. 1, 2014

(54) HIGH INTENSITY DISCHARGE LAMP WITH IGNITION AID

(75) Inventors: Tamas Panyik, Budapest (HU); Raghu Ramaiah, Mentor, OH (US); Zoltan Janki, Budapest (HU); Roland Csongvai, Budapest (HU)

(73) Assignee: General Electric Company, Schenectady, NY (US)

( * ) Notice: Subject to any disclaimer, the term of this patent is extended or adjusted under 35 U.S.C. 154(b) by 383 days.

(21) Appl. No.: 13/178,918

(22) Filed: Jul. 8, 2011

(65) Prior Publication Data

US 2013/0009532 A1 Jan. 10, 2013

(51) Int. Cl.

| | |
|---|---|
| ***H01J 7/40*** | (2006.01) |
| ***H01J 17/32*** | (2006.01) |
| ***H01J 65/08*** | (2006.01) |

(52) U.S. Cl.

USPC ..... 313/54; 313/623

(58) Field of Classification Search

USPC ..... 313/54, 623, 625, 527; 250/381, 382

See application file for complete search history.

(56) References Cited

U.S. PATENT DOCUMENTS

| | | | | |
|---|---|---|---|---|
| 4,037,129 | A | 7/1977 | Zack | |
| 4,053,809 | A | 10/1977 | Fridrich et al. | |
| 4,445,073 | A | 4/1984 | Wyner et al. | |
| 4,491,766 | A | 1/1985 | Larson | |
| 5,325,017 | A | 6/1994 | Schellen | |
| 5,541,480 | A | 7/1996 | Renardus et al. | |
| 5,661,367 | A | 8/1997 | Fellows et al. | |
| 5,955,845 | A * | 9/1999 | Fellows | 315/189 |
| 6,126,887 | A * | 10/2000 | Ward et al. | 264/608 |
| 6,198,223 | B1 | 3/2001 | Scholz | |
| 6,201,348 | B1 | 3/2001 | Nortrup et al. | |
| 6,222,320 | B1 | 4/2001 | Stockwald | |
| 6,844,676 | B2 | 1/2005 | Alderman et al. | |
| 6,861,805 | B2 | 3/2005 | Jackson et al. | |
| 6,943,498 | B2 | 9/2005 | Nishiura et al. | |

(Continued)

FOREIGN PATENT DOCUMENTS

| | | | |
|---|---|---|---|
| DE | 102004035931 | A1 | 2/2006 |
| DE | 202010010561 | U1 | 9/2010 |

(Continued)

OTHER PUBLICATIONS

PCT Invitation to Pay Additional Fees dated Dec. 13, 2012 from related Application No. PCT/US2012/055292.

(Continued)

*Primary Examiner* — Nimeshkumar Patel
*Assistant Examiner* — Glenn Zimmerman
(74) *Attorney, Agent, or Firm* — Pearne & Gordon LLP

(57) ABSTRACT

A high intensity discharge lamp includes an electrically insulating arc tube. A sealed shroud encloses the arc tube. An electrically conductive frame member is disposed inside the shroud and is electrically connected to an electrical conductor that extends in the arc tube. Electrically conductive foil is fastened to the frame member and forms a closed loop that encircles a leg of the arc tube by an angle in a range of at least 270 degrees to 360 degrees. The foil can be connected to the frame member and to itself. A distance from an outer surface of a flange of the arc tube leg to a proximal edge of the foil can range from 1.5 to 8 mm. A width of the foil can range from 1 mm to 4 mm.

31 Claims, 9 Drawing Sheets

(56) References Cited

U.S. PATENT DOCUMENTS

| | | | | |
|---|---|---|---|---|
| 6,995,513 | B2 | 2/2006 | Alderman et al. | |
| 7,331,837 | B2 | 2/2008 | Jackson et al. | |
| 7,852,004 | B2 | 12/2010 | Li et al. | |
| 7,884,549 | B2 | 2/2011 | Scholler et al. | |
| 2002/0185973 | A1 | 12/2002 | Jackson et al. | |
| 2003/0006705 | A1 | 1/2003 | Alderman | |
| 2003/0025455 | A1 | 2/2003 | Alderman et al. | |
| 2003/0173902 | A1 | 9/2003 | Venkataramani et al. | |
| 2004/0227445 | A1 | 11/2004 | Kai | |
| 2005/0194908 | A1 | 9/2005 | Dakin et al. | |
| 2008/0303402 | A1 | 12/2008 | Li et al. | |
| 2009/0009084 | A1 | 1/2009 | Bonigk et al. | |
| 2009/0224675 | A1 | 9/2009 | Pekarski et al. | |
| 2009/0251053 | A1 | 10/2009 | Ramaiah | |
| 2009/0322225 | A1 | 12/2009 | Kostrun et al. | |
| 2011/0074285 | A1 | 3/2011 | Buttstaedt et al. | |
| 2012/0139412 | A1* | 6/2012 | Brauner et al. | 313/623 |
| 2012/0146497 | A1 | 6/2012 | Stockwald | |
| 2012/0146498 | A1 | 6/2012 | Utsubo | |

FOREIGN PATENT DOCUMENTS

| | | | |
|---|---|---|---|
| DE | 102009029867 | A1 | 12/2010 |
| EP | 453652 | A2 | 8/1995 |
| EP | 967631 | A1 | 12/1999 |
| EP | 722184 | A2 | 9/2000 |
| EP | 1069596 | A2 | 1/2001 |
| EP | 1220298 | A1 | 7/2002 |
| EP | 938127 | A1 | 10/2002 |
| EP | 1298706 | A2 | 4/2003 |
| EP | 1037259 | B1 | 10/2003 |
| EP | 1355345 | A1 | 10/2003 |
| EP | 1006561 | B1 | 6/2004 |
| EP | 1033742 | A2 | 7/2005 |
| EP | 1626435 | A2 | 2/2006 |
| EP | 834905 | B1 | 11/2008 |
| EP | 2171743 | A2 | 4/2010 |
| EP | 2306492 | A1 | 4/2011 |
| JP | 2001283781 | A | 10/2001 |
| JP | 2001345076 | A | 12/2001 |
| JP | 2004095539 | A | 3/2004 |
| JP | 2006173108 | A | 6/2006 |
| JP | 2010010132 | A | 1/2010 |
| JP | 2010010135 | A | 1/2010 |
| WO | 9742651 | A2 | 11/1997 |
| WO | 9807180 | A1 | 2/1998 |
| WO | 0077826 | A1 | 12/2000 |
| WO | 0237532 | A1 | 5/2002 |
| WO | 02091428 | A2 | 11/2002 |
| WO | 03019616 | A2 | 3/2003 |
| WO | 04001793 | A1 | 12/2003 |
| WO | 2005104183 | A2 | 11/2005 |
| WO | 2006076879 | A1 | 7/2006 |
| WO | 2008154102 | A2 | 12/2008 |
| WO | 2009049661 | A1 | 4/2009 |
| WO | 2010149458 | A1 | 12/2010 |
| WO | 2011018118 | A1 | 2/2011 |
| WO | 2011018122 | A1 | 2/2011 |
| WO | 2011018326 | A1 | 2/2011 |
| WO | 2011018327 | A1 | 2/2011 |
| WO | 2011038975 | A1 | 4/2011 |

OTHER PUBLICATIONS

Partial Search Report from corresponding International Application No. PCT/US2012/045513, dated Oct. 26, 2012.

PCT Search Report and Written Opinion dated Apr. 8, 2013 from corresponding Application No. PCT/US2012/055292.

* cited by examiner

HIGH INTENSITY DISCHARGE LAMP WITH IGNITION AID

FIELD OF THE INVENTION

This disclosure relates to high intensity discharge lamps, and in particular, to ignition aids used in such lamps.

BACKGROUND OF THE INVENTION

Differences exist in speed of breakdown and the number of electrons needed to initiate a self-sustained discharge, but the underlying breakdown mechanism is the same for low pressure discharges (e.g., fluorescent lamps) or high pressure discharges (arc discharge lamps). Discharge is initiated between two conductors that are given opposite electric potential. The space between the conductors usually comprises a gas, and efforts are made to maintain the quality/purity of the gas by enclosing it in a hermetic vessel. The essential end result of the discharge is the creation of a plasma between the two conductors. Plasma is defined as a conductive medium, containing equal proportions of electron and ions, which allows for conduction of electric current through an otherwise insulator material, i.e., the gas in its initial state.

Initially, the gas contained in the arc tube is non-conductive. If an electric potential is applied on the conductors, this creates a favorable situation to strip the outer orbital electrons from the atoms of the gas and thus create free electrons, which are then accelerated though the gas by the electric field generated between the conductors, and initiates more electrons by collision with gas atoms, which in turn are ionized. If the electric field is high enough, each electron thus created will create additional electrons by inelastic collisions with gas atoms and ions, and initiates an electron avalanche. Such an avalanche creates the discharge. However, to create such electrons by simple dielectric breakdown of the gas atoms by the electric field requires several kilovolts of electric potential. Higher and higher electric potentials require more expensive external electrical circuitry, and may not be commercially feasible. Unwanted breakdown can also occur in the outer jacket and in the cap-base region.

Discharges for commercial applications employ an additional source of free electrons, which removes the need for generating such high voltages to initiate the discharge. Such external sources can be a heated filament, use of the ever present cosmic rays, or providing a source of electrons by radioactive decay. Heated filaments are not practical in high intensity discharge (HID) lamps, and the cosmic ray background radiation is insufficient to dramatically reduce the need for very high electric fields needed to initiate the ignition, unless other methods are used to lower the breakdown voltage.

For providing a source of electrons by radioactive decay, typically what has been used in the past in the HID arc tube is a radioactive gas, such as $Kr^{85}$ with most of the decay products being beta particles (i.e., electrons). $Kr^{85}$ has a half-life of 10.8 years, with 99.6% of the decay products being beta particles (i.e., electrons) having a maximum kinetic energy of 687 kev. These electrons have very high energy, and in many respects are an ideal source for free electrons and used widely as such for these applications. But to provide enough of these high energy electrons by radioactive decay, significant quantity of this gas has been used in HID lamps.

The presence of $Kr^{85}$ in such lamps diminishes the need for providing very high electric potential on the conductors, which makes the external electrical circuitry (a ballast) and systems design simpler and more cost effective. Typical applications use such a radioactive gas with a ballast that provides a high electric pulse for a very short duration, typically in the millisecond (microsecond) range, that is very effective in creating the electron avalanche referred to earlier. However, recent UN2911 government regulations limit the amount of radioactive $Kr^{85}$ used in lamps. These regulations proscribe the HID lamp manufacturers from using the large quantity of $Kr^{85}$ gas that has been previously used, as described in preceding paragraph.

A number of ignition aids have been designed for improving the ignition of high intensity discharge lamps. U.S. Patent application Pub. No. 2002/0185973 discloses a lamp in which wire is wrapped around both legs of the arc tube and its central body as both an ignition aid and for containment, but are not connected to the electrodes. Another reference, U.S. Pat. No. 5,541,480, discloses an ignition aid in which a conductor that is coated on an exterior surface of an arc tube of constant diameter between the electrodes is connected to a conductive frame wire that contacts an electrode. U.S. Pat. No. 6,222,320 discloses an ignition aid for a lamp including an arc tube having a central body portion and smaller diameter legs extending from the body portion, wherein a conductor that is in contact with a conductive frame wire that contacts one of the electrodes, contacts only the central body portion of the arc tube.

BRIEF DESCRIPTION OF THE INVENTION

A need to reduce the $Kr^{85}$ content in HID lamps exists, but such reduction could have serious consequence to discharge initiation, and consequently unacceptable performance. This invention describes a means to obviate this disadvantage of lowering the $Kr^{85}$ gas content.

In one embodiment of this disclosure, a high intensity discharge lamp includes an electrically insulating arc tube including light transmissive material having a central portion and two legs each of which extends from the central portion. The central portion forms an interior discharge region in which an ionizable material is sealed therein. Electrical conductors each extend through one of the legs and are spaced apart from each other in the discharge region. A sealed shroud including light transmissive material encloses the arc tube and there is electrical connection to the electrical conductors through the sealed shroud. An electrically conductive frame member is disposed in an interior of the shroud and is electrically connected to one of the electrical conductors. An ignition aid including electrically conductive foil is fastened to the frame member and forms a closed loop that encircles one of the legs of the arc tube around one of the electrical conductors. The foil is insulated from the adjacent electrical conductor. The foil encircles the leg by an angle in a range of at least 270 degrees to 360 degrees. The foil includes two end portions, and a central portion therebetween that encircles the arc tube leg. A first end portion of the foil is connected to the frame member and a second end portion of the foil is connected to the foil between the central portion and the first end portion of the foil.

Referring to the following specific aspects of the high intensity discharge lamp of this disclosure, which can be used alone or in any combination in all embodiments disclosed herein, the legs and central body portion of the arc tube may have a circular cross-sectional shape. The legs are smaller in diameter than the arc tube. The foil can encircle the leg by the range of at least 300 degrees to 360 degrees, and in particular, by the range of at least 320 degrees to 360 degrees. There is no electrical conductor encircling an exterior surface of the other arc tube leg (the leg that is not in contact with the foil) or disposed on an exterior surface of the central portion of the arc tube. A width of the foil ranges from 1.0 mm to 4.0 mm and, more specifically, from 1.0 mm to 3.0 mm, in particular from 1.0 mm to 2.0 mm. A thickness of the foil is less than 0.2 mm, more specifically ranging from 0.01 mm to 0.15 mm, in particular in a range of 0.01 mm to 0.08 mm and specifically can be 0.076 mm. A ratio of a width of the foil to a thickness of the foil ranges from 6.6:1 to 400:1. Each of the legs of the arc tube can include a flange and a boss extending from the flange into the discharge region so that the flange abuts the central portion. The central portion can be a cylindrical barrel. A distance from an outer surface of the flange to a proximal edge of the foil is not more than 8.0 mm and, in particular, not more than 2.0 mm.

The arc tube can include polycrystalline alumina. The discharge region can be filled with inert gas (e.g., argon gas), krypton gas and a dose of mercury and metal halides. A mixture of argon gas and $Kr^{85}$ gas present in the discharge region can have an activity concentration of not greater than 0.16 MBq/liter. The arc tube can be at a pressure of 100-500 millibar. The electrical conductors can include a first conductor to which voltage is applied and a second conductor spaced apart from the first conductor in the arc tube, wherein the frame member is electrically connected to the second conductor (and does not connect with the first conductor) and the foil is wrapped around the leg around the first conductor. The first end portion of the foil can be connected to the frame member, and the second end portion of the foil can be connected to the foil, by welding. The foil can be comprised of a base metal selected from the group consisting of Nb, Mo, Ta, Pt, Re, W, Ni, and combinations thereof, and a combination of any of the base metals with cladding comprised of one or more of the base metals.

A second embodiment of the disclosure features a high intensity discharge lamp. An electrically insulating arc tube comprised of light transmissive material has a central portion and two legs each of which extends from the central portion. The central portion forms an interior discharge region. Each of the legs includes a flange and a boss extending from the flange into the discharge region so that the flange abuts the central portion. Electrical conductors each extend through one of the legs and are spaced apart from each other in the discharge region. A sealed shroud comprised of light transmissive material encloses the arc tube and there is electrical connection to the electrical conductors through the sealed shroud. An electrically conductive frame member disposed in an interior of the shroud is electrically connected to one of the electrical conductors. An ignition aid comprises electrically conductive foil that is fastened to the frame member and forms a closed loop that encircles one of the legs of the arc tube around one of-the electrical conductors. The foil encircles the leg by an angle in a range of at least 270 degrees to 360 degrees. A distance from an outer surface of the flange to a proximal edge of the foil ranges from 1.5 to 8 mm.

As to specific features of the lamp of the second embodiment, a thickness of the foil can range from 0.01 mm to 0.15 mm. A width of the foil can range from 1 mm to 4 mm. A mixture of argon gas and $Kr^{85}$ gas present in the discharge region can have an activity concentration of not greater than 0.16 MBq/liter. Any of the specific features discussed in connection with the lamp of the first embodiment can also be used in the lamp of the second embodiment.

A third embodiment of the disclosure features a high intensity discharge lamp that includes an electrically insulating arc tube including light transmissive material having a central portion and two legs each of which extends from the central portion. The central portion forms an interior discharge region in which an ionizable material is sealed therein. Electrical conductors each extend through one of the legs and are spaced apart from each other in the discharge region. A sealed shroud including light transmissive material encloses the arc tube and there is electrical connection to the electrical conductors through the sealed shroud. An electrically conductive frame member is disposed in an interior of the shroud and is electrically connected to one of the electrical conductors. An ignition aid including electrically conductive foil is fastened to the frame member and forms a closed loop that encircles one of the legs of the arc tube around one of the electrical conductors. The foil is insulated from the adjacent electrical conductor. The foil encircles the leg by an angle in a range of at least 270 degrees to 360 degrees. A width of the foil ranges from 1 mm to 4 mm.

Referring to specific aspects of the third embodiment, each of the legs can include a flange and a boss extending from the flange into the discharge region so that the flange abuts the central portion. A distance from an outer surface of the flange to a proximal edge of the foil ranges from 1.5 to 8 mm. A thickness of the foil ranges from 0.01 mm to 0.15 mm. A mixture of argon gas and $Kr^{85}$ gas present in the discharge region can have an activity concentration of not greater than 0.16 MBq/liter. Any of the specific features discussed in connection with the lamp of the first embodiment can also be used in the lamp of the third embodiment.

The high intensity discharge lamps of this disclosure advantageously exhibit good ignition even when using low amounts of $Kr^{85}$ gas, which limits the availability of free electrons by radioactive decay. In particular, a mixture of argon gas and $Kr^{85}$ gas present in the discharge region can have an activity concentration of not greater than 0.16 MBq/liter. Particular features of the foil ignition aid of the high intensity discharge lamps of this disclosure, including foil width, foil wrapping angle around the arc tube leg and spacing of the foil away from the central portion of the arc tube, have been determined in this disclosure to lead to increasing Emax or the maximum electric field at the tip of the electrode, and results in improved ignition of the lamp even though low $Kr^{85}$ gas is used.

It should be appreciated that terms such as upper, lower, top, bottom, right, left, and the like are relative terms that will change with the orientation of the lamp. These terms are used for improving understanding in this disclosure and should not be used to limit the invention as defined in the claims.

Many additional features, advantages and a fuller understanding of the invention will be had from the accompanying drawings and the Detailed Description of the Invention that follows. It should be understood that the above Brief Description of the Invention describes the invention in broad terms while the following Detailed Description of the Invention describes the invention more narrowly and presents embodiments that should not be construed as necessary limitations of the broad invention as defined in the claims.

DETAILED DESCRIPTION OF THE INVENTION

Figure 1:
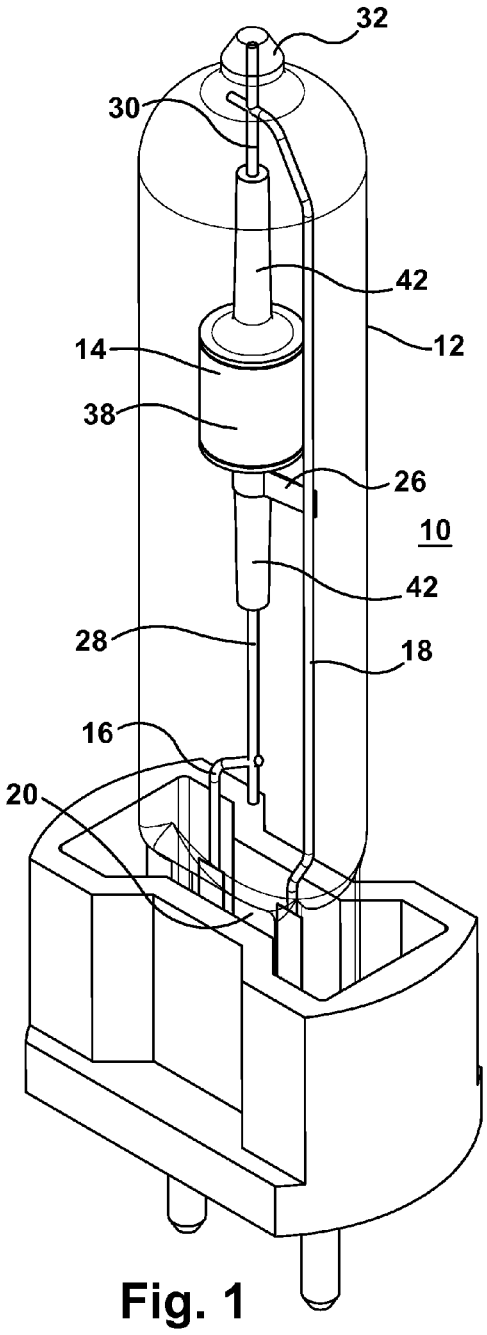
FIG. 1 is a side elevational view of a single ended high intensity discharge lamp with foil ignition aid of this disclosure.

Referring to FIG. 1, a ceramic metal halide high intensity discharge lamp 10 includes an outer shroud or bulb 12 enclosing an arc tube 14. This is a single ended lamp in that electrical contacts are located on only one end of the lamp. Electrically conductive frame members or wires 16, 18 are embedded in a glass pinch portion 20 at one end of the outer bulb 12. Leads 22 extending from contact pins 24 external to the outer bulb 12 are electrically connected to the frame wires 16, 18 by electrically conductive foil 26 located in the pinch portion 20. Each foil 26 is welded to one of the leads 22 and to one of the frame wires 16, 18. Electrically conductive feedthroughs 28, 30 extend into each end of the arc tube. The lower feedthrough 28 is welded to the short frame member 16 while the upper feedthrough 30 is welded to the long frame member 18. The upper feedthrough 30 extends upwardly past the connection with the long frame member 18 and is retained in place by being in contact with a portion 32 of glass of the outer bulb that has been partially melted around the feedthrough 30 during manufacturing. The long frame member 18 extends along the length of the arc tube but is spaced apart from a side 34 of the arc tube 14 near a side wall 36 of the outer bulb 12. The frame members 16, 18 are formed of rigid wire and support the arc tube 14 inside the outer bulb 12 preventing its movement.

Figure 2A:
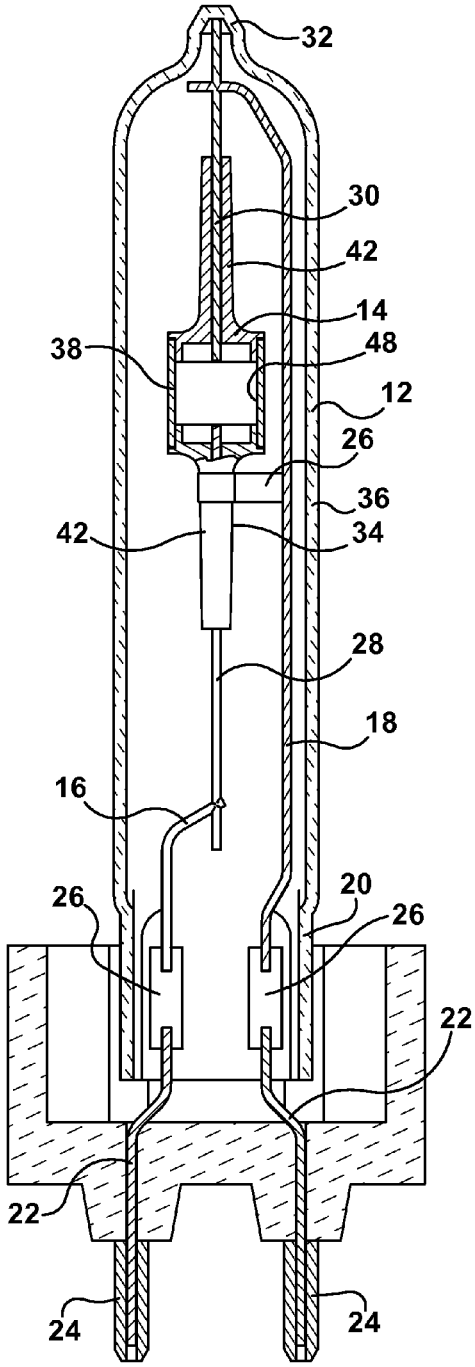
FIG. 2A is a vertical cross-sectional view of the lamp of FIG. 1.
Figure 2B:
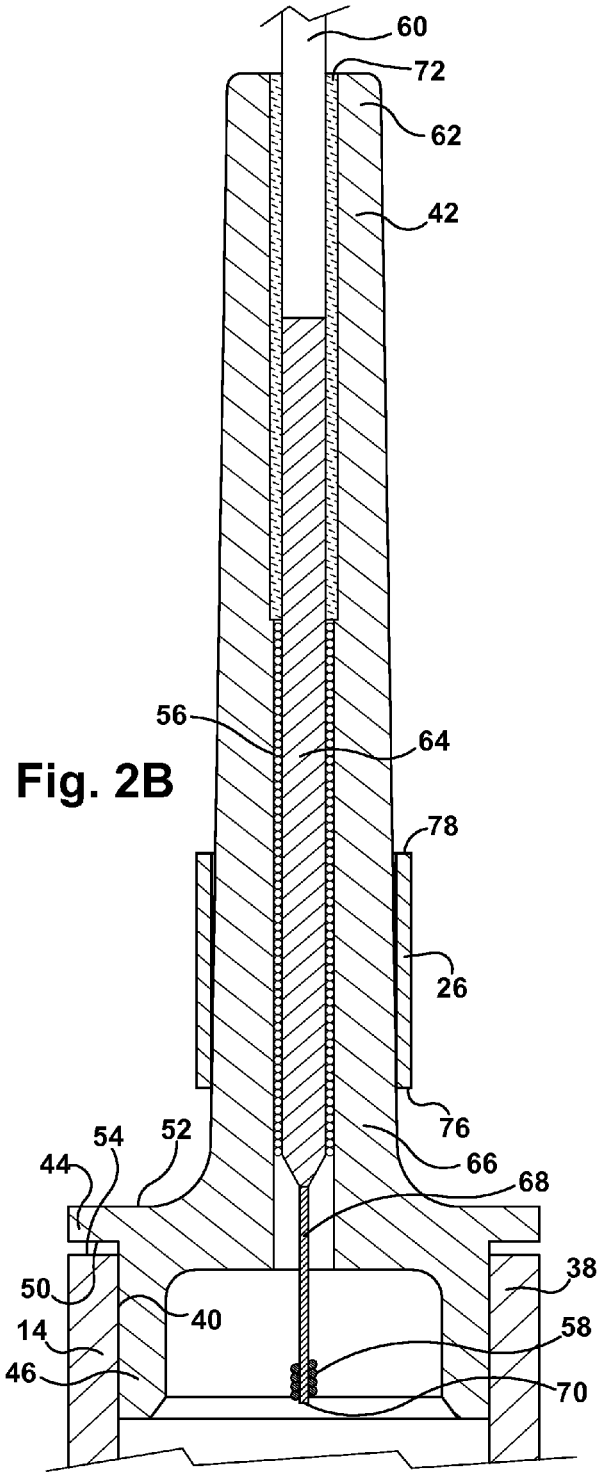
FIG. 2B is an enlarged cross-sectional view of the arc tube of FIG. 2A.

Referring to FIG. 2B, the arc tube 14 includes a tubular central barrel shaped portion 38 of constant diameter and openings 40 at either end of the barrel portion. Two legs or capillaries 42 extend from the central portion 38. The arc tube body and legs can be formed of light transmitting ceramic material such as polycrystalline alumina. Each of the legs 42 can include a flange 44 and a boss 46 extending from the flange into the opening 40 of the central portion into an interior discharge region 48 of the barrel portion 38. The legs each include inner flange surface 50 and outer flange surface 52, the inner flange surface 50 abutting a side face 54 of the cylindrical barrel portion 38. The legs 42 include passages 56 along their length. The conductive feedthroughs 28, 30 extend into the passages 56 and are electrically connected to electrodes 58 that are spaced apart from each other in the discharge region. The feedthroughs 28, 30 are electrically conductive. In one example, there is a niobium feedthrough portion 60 that extends from outside the leg into the distal portion 62 of the leg remote from the central portion 38. The niobium feedthrough portion 60 is electrically connected to a molybdenum feedthrough portion 64, which can include a central wire with material coiled around it. At proximal leg portion 66 near the central portion 38 and connected to the molybdenum feedthrough is a tungsten portion 68 of the electrode 58 also including conductive material coiled around it and having a tip 70. The coils around the feedthrough portion 64 and around the tungsten portion 68 are the same material as the wire they wrap around. The foil is comprised of a base metal selected from the group consisting of Nb, Mo, Ta, Pt, Re, W, Ni, combinations thereof and a combination of any of the above base metals with cladding composed of one or more of the base metals. The cladding improves weldability of the foil. Those skilled in the art will appreciate in reading this disclosure that various differences in the feedthrough and electrode design and composition can be made without departing from the scope of this disclosure. A glass frit 72 is used inside the passages 56 of the legs 42 around the niobium and molybdenum feedthrough portions to hermetically seal the arc tube after ionizable material has been charged into it. Foil 26 is disposed around the arc tube leg at a location of the molybdenum feedthrough. The foil 26 has a proximal edge 76 and a distal edge 78, the proximal edge being located closer to the central portion 38 than the distal edge. The proximal edge 76 is located a distance, d, away from the outer flange surface 52 of the leg 42, which is discussed in more detail below.

Figure 3:
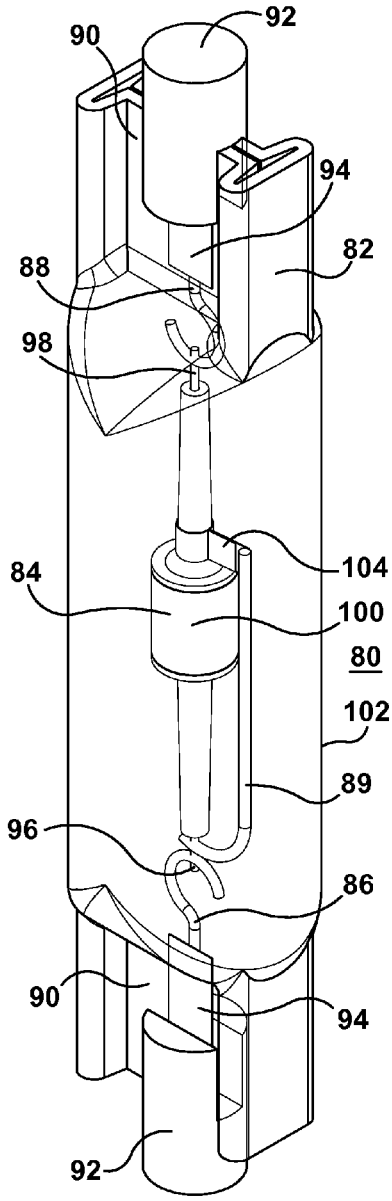
FIG. 3 is a side elevational view of a double ended high intensity discharge lamp with foil ignition aid of this disclosure.

Referring to FIG. 3, a ceramic metal halide high intensity discharge lamp 80 of a second embodiment includes an outer shroud or bulb 82 enclosing an arc tube 84. This is a double ended lamp in that contacts are located at both ends of the lamp. Electrically conductive end frame members 86, 88 are embedded in glass at each of the opposite pinch portions 90 of outer bulb 82. Contacts 92 external to the outer bulb are electrically connected to electrically conductive foil 94 located in the pinch portions 90. Each foil 94 is welded to a connector fitted into one of the contacts 92 and to one of the end frame members 86, 88. The electrical connection between the foil and contact is not shown. Electrically conductive feedthroughs 96, 98 extend into each end of the arc tube 84. The lower feedthrough 96 is welded to a central frame member 89 that extends along the length of the arc tube but is spaced apart from a side of the arc tube 100 near a side wall 102 of the outer bulb. The frame members 86, 88, 89 are made of rigid wire and support the arc tube 84 inside the outer bulb 82 preventing its movement. The central frame member 89 is electrically connected to one conductor (feedthrough 96) that extends into the arc tube 84 and supports foil 104 around the other conductor (feedthrough 98) on the other leg of the arc tube while being electrically insulated from that conductor. The arc tube 14 and its feedthroughs 28, 30 of the lamp of the first embodiment have the same features as the arc tube 84 and its feedthroughs 96, 98.

Into the discharge region 48 is charged an ionizable material including an inert gas (e.g., argon), metal halide and mercury. Krypton 85 ($Kr^{85}$) gas may also be used in the discharge region in amounts reduced to comply with government regulations; for example, a mixture of argon gas and $Kr^{85}$ gas present in the discharge region can have an activity concentration of not greater than 0.16 MBq/liter. The composition of the gas in the arc tube at room temperature is argon and krypton with some mercury. The dose in the lamp, for example, can include 5.7 mg of Hg and the following (weight %) metal halides: 51.2% NaI, 6.8% TlI, 16.6% $LaI_3$ and 25.4% $CaI_2$. The total dose weight of these halides can be 12 mg.

Electrical current supplied to the contacts reaches the electrodes via the frame members and feedthroughs, and generates an arc between the electrodes. One electrode (e.g., the electrode connected to feedthrough 28 in FIG. 2A) is provided an AC operating voltage by the ballast while the other electrode is at the opposite potential. The electrode connected to feedthrough 30 in FIG. 2A can be grounded. Ignition voltage pulses and rms operating voltage are provided to the lamp via the ballast. It should be appreciated that the one electrode referred to above can be the opposite as what is shown and described regarding each of FIGS. 2A and 3. For example, the electrode connected to feedthrough 30 can receive the full applied voltage from the ballast while the electrode connected to feedthrough 28 is grounded. Alternatively, the applied voltage to the lamp can be a floating voltage, i.e., each electrode can have voltage applied to it in AC cycle (equal, but opposite).

A foil ignition aid is used to improve ignition of the lamp. The ignition aid includes electrically conductive foil (26, 104) that is fastened to the frame member (18, 89) and encircles a leg of the arc tube around a feedthrough extending in that leg. The foil is spaced apart and electrically insulated from the feedthrough it encircles by the electrically insulating ceramic material of the arc tube leg. While not wanting to be bound by theory it is believed that the foil (26, 104) functions as a capacitor. There is no electrical conductor encircling the arc tube leg opposite the foil ignition aid or at the central portion of the arc tube. For example, turning to FIG. 1, there is no electrical conductor on the upper leg 42 or on the barrel portion 38 in this example. Although the foil is typically disposed proximal to the lower electrode (FIG. 1), the foil might also be disposed proximal to the upper electrode instead as shown in FIG. 3.

Figure 4:
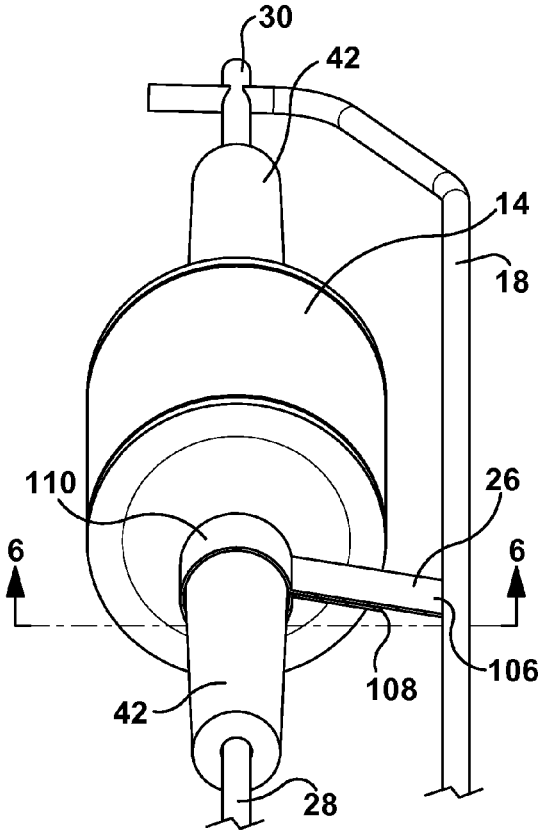
FIG. 4 is a perspective view showing an arc tube and one aspect of the foil ignition aid of this disclosure.
Figure 5:
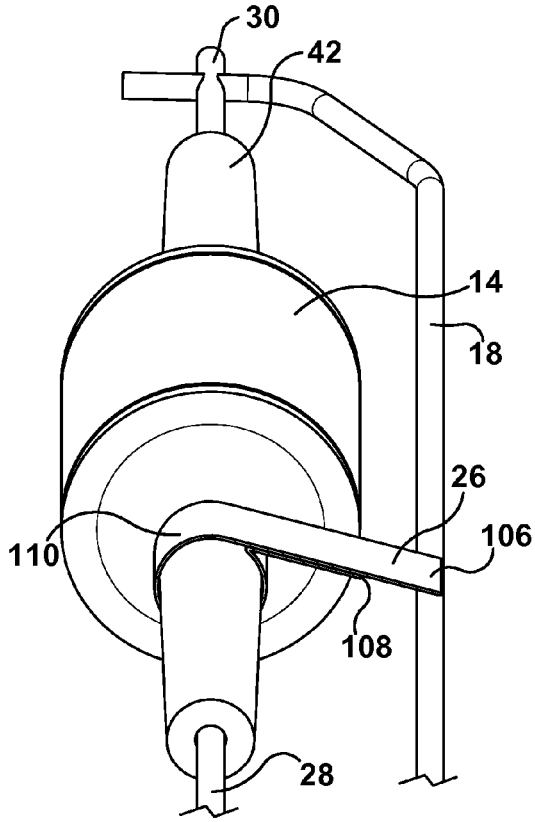
FIG. 5 is a perspective view showing an arc tube and another aspect of the foil ignition aid of this disclosure.
Figure 6:
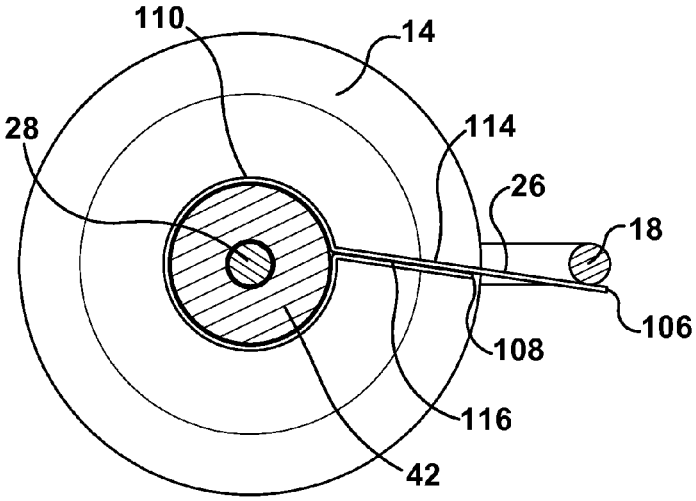
FIG. 6 is a cross sectional view taken from the cutting plane designated 6-6 in FIG. 4.
Figure 7:
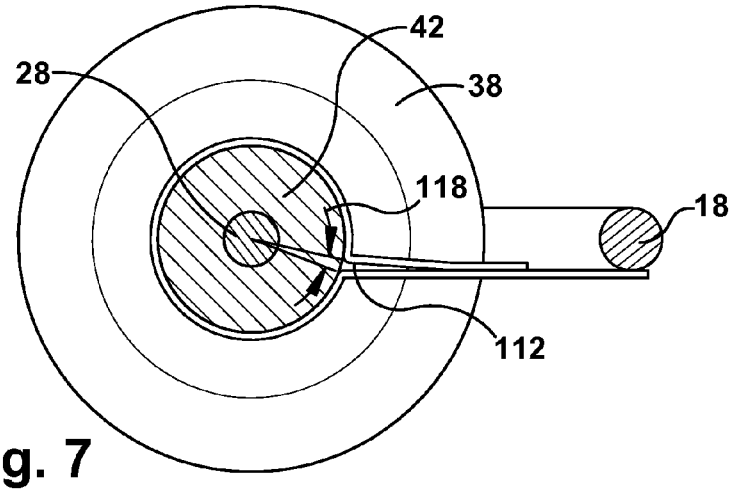
FIGS. 7-9 are cross-sectional end views of arc tubes showing small spaces between sections of the foil as they encircle the arc tube legs in different ways.
Figure 8:
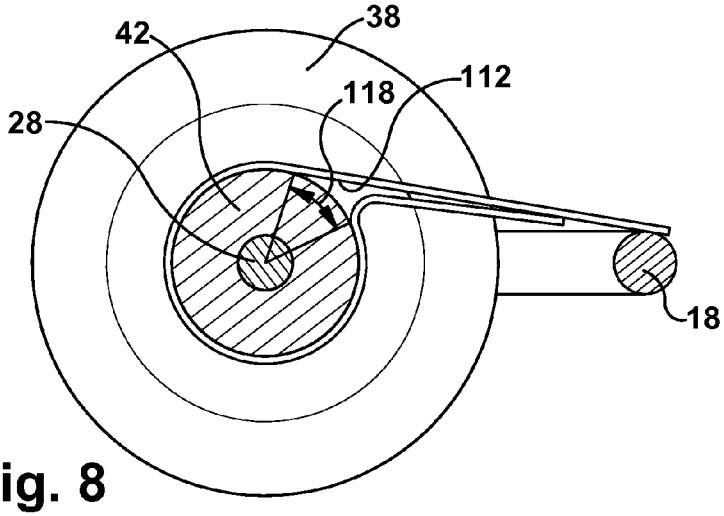
Figure 9:
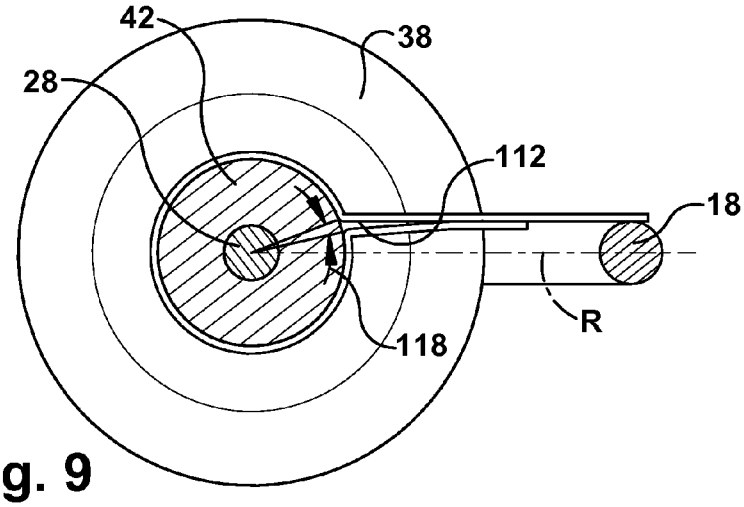

Referring to FIGS. 4-6, the foil 26 includes two end portions 106, 108 and a central portion 110 between the end portions. The central portion 110 encircles, and together with the straight sections of the foil, forms a closed loop around the electrically insulating arc tube leg 42. Reference to encircling the leg for the stated degrees refers to the angle by which the foil is in contact with the circumference of the leg. One (first) end portion 106 of the foil is welded to the frame member 18 and the other (second) end portion of the foil 108 is welded to the foil 26 between the central portion 110 and the first end portion 106 that is welded to the frame member 18. The second end portion of the foil 108 is welded as close as possible to the leg 42 so as to minimize the space 112 formed between the foil and the arc tube (FIGS. 7-9). The foil is formed asymmetrically. It includes a longer section 114 that is welded to the frame member 18 and a shorter section 116 that is welded to the foil (FIG. 6). While encircling the arc tube leg, the foil contacts all or a portion of the circumference of the leg. The two welds, the encircling of the arc tube leg and the closed loop of the foil are sufficient to maintain the foil in contact with the leg even withstanding standard drop tests of the lamp.

Figure 20:
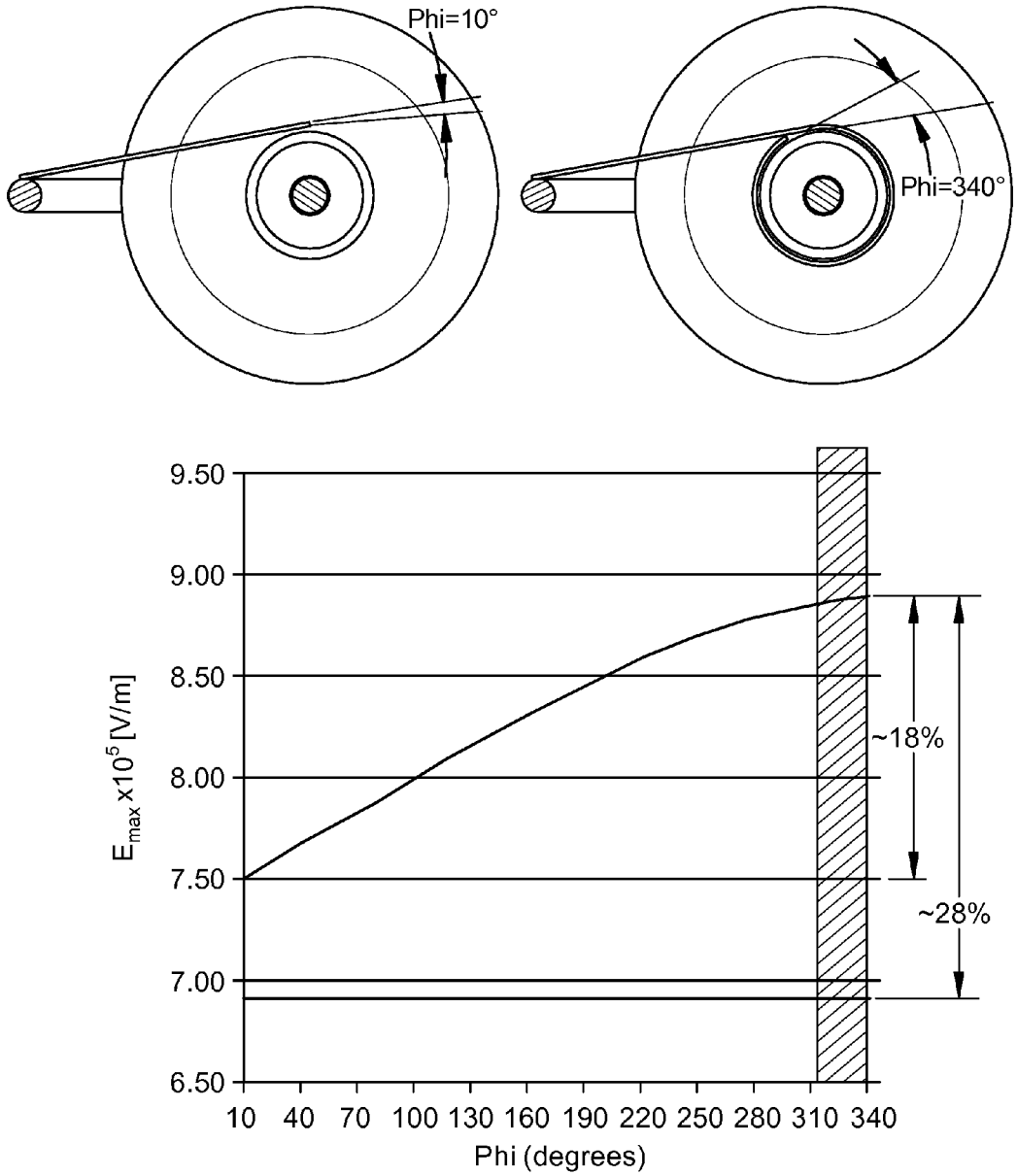
FIG. 20 is a figure showing electrostatic simulation results of Emax vs wrapping angle of the foil around the arc tube leg.

The measurement of the wrapping angle, ψ (Phi), by which the foil encircles the arc tube leg can be seen in FIG. 20 showing the end view of the leg. The angle is determined by drawing a reference line from the frame to the point at which the foil contacts the circular arc tube leg and then moving around the arc tube leg for the angle of the indicated degrees until reaching a line tangent to the circle of the arc tube leg. The wrapping angle, Phi, by which the foil encircles the arc tube leg while contacting it can be at least 270 degrees, in particular, at least 300 degrees, more particularly, at least 320 degrees. The wrapping angle, Phi, is not more than 360 degrees. As shown in FIG. 7-9, 360 degrees less the degrees that the foil encircles the leg (the wrapping angle), represents the arc 118 of the space 112 that might exist between the foil sections 114, 116 on the leg. This arc 118 of the space 112 can be 90 degrees, 60 degrees, 40 degrees, 5 degrees, 3 degrees, or even 0 (theoretically), depending on the design and the constraints of the equipment used to bend and weld the foil. The foil does not wind around the leg more than 360 degrees, i.e., it is unlike a wire that is coiled around the leg for multiple windings.

Figure 10:
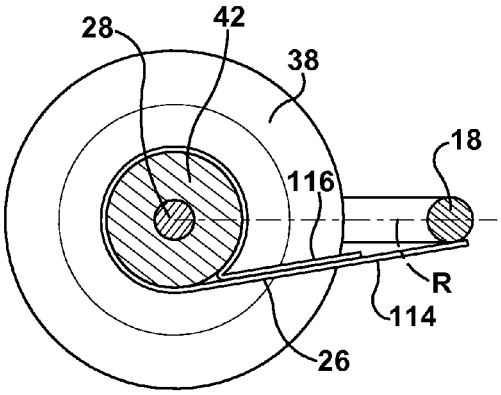
FIGS. 10-15 show different arrangements by which the foil may connect to a frame member and encircle the leg of the arc tube.
Figure 11:
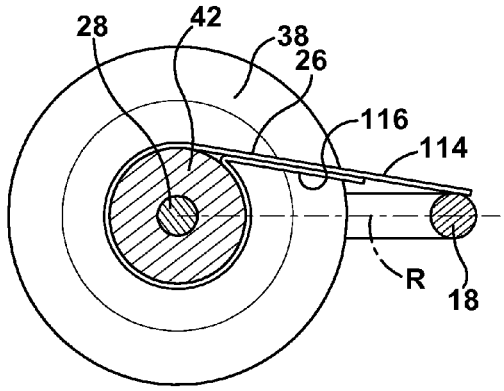
Figure 12:
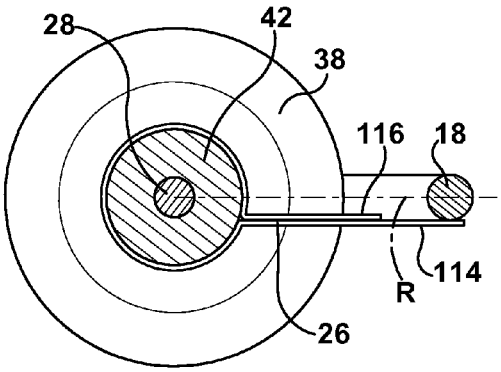
Figure 13:
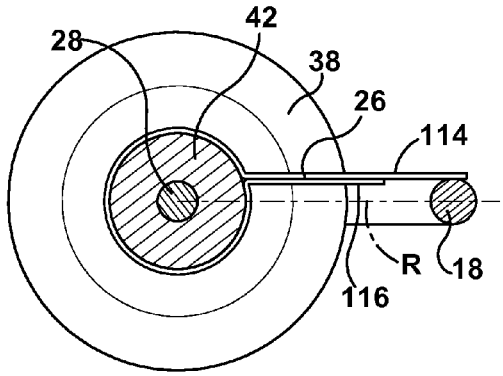
Figure 14:
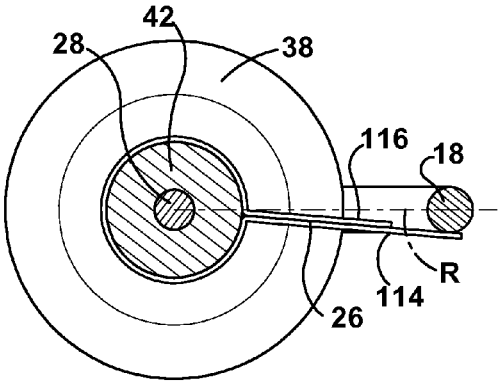
Figure 15:
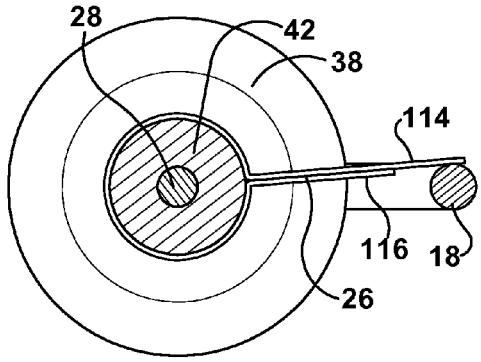

Viewing from an end of the arc tube leg in FIGS. 10-15, a reference plane, R, interconnects a center point of the arc tube leg 42 and center point of the frame member 18. The foil 26 can be oriented so as to travel from the welded point on the frame member toward the arc tube leg, parallel to the reference plane (FIGS. 12 and 13), toward the reference plane (FIGS. 14 and 15) or away from the reference plane (FIGS. 10 and 11).

A width, w, of the foil ranges from 1.0 mm to 4.0 mm and, more specifically, ranges from 1.0 mm to 3.0 mm, in particular from 1.0 mm to 2.0 mm. A thickness of the foil is less than 0.2 mm, more specifically ranging from 0.01 mm to 0.15 mm, in particular in a range of 0.01 mm to 0.08 mm and specifically can be 0.076 mm. A ratio of a width of the foil to a thickness of the foil ranges from 6.6:1 to 400:1. The foil of this disclosure is different from a wire in terms of its geometry and electric field that can be generated. As width and thickness are the same for wire of a given diameter, the ratio of wire width to wire thickness is 1:1, much less than the foil width: foil thickness ratio of this disclosure.

The reason the foil is a further enhancement of the lamp starting phenomenon is described below. For purposes of explanation, a conventional discharge lamp does not have the foil starting aid, but contains $Kr^{85}$ gas and Ar gas. A ballast is used to apply the high voltage transient pulse between the electrodes contained in the hermetically sealed discharge region of the arc tube. Relatively high concentrations of $Kr^{85}$ gas that exceed current government regulations (e.g., 6.2 MBq/l) are used in the conventional discharge lamp to allow for the discharge to be initiated reliably over the rated life of such lamps. The electric field generated in the conventional discharge lamp is defined as the applied voltage/gap between the electrodes. The larger the gap between the electrodes, the lower the electric field. The lower the electric field, the harder it is to reliably initiate the discharge, even though $Kr^{85}$ gas and the high voltage electric pulse that is provided by the ballast, are present. Referring to FIG. 2A, including the foil aid of this disclosure as shown, the electric field in the lamp is much higher, by virtue of the fact that the gap is now between, for example, the foil and the adjacent electrode. This gap is much smaller than the gap between the electrodes and hence the electric field is much larger, and the creation of the electron avalanche that much easier. Essentially, the upper electrode has been replaced by the foil, as the foil is electrically connected to the upper electrode.

The lamp of this disclosure will now be described by reference to the following examples, which present more specific information that should not be used to limit the invention as described by the claims.

EXAMPLE 1

Figure 16:
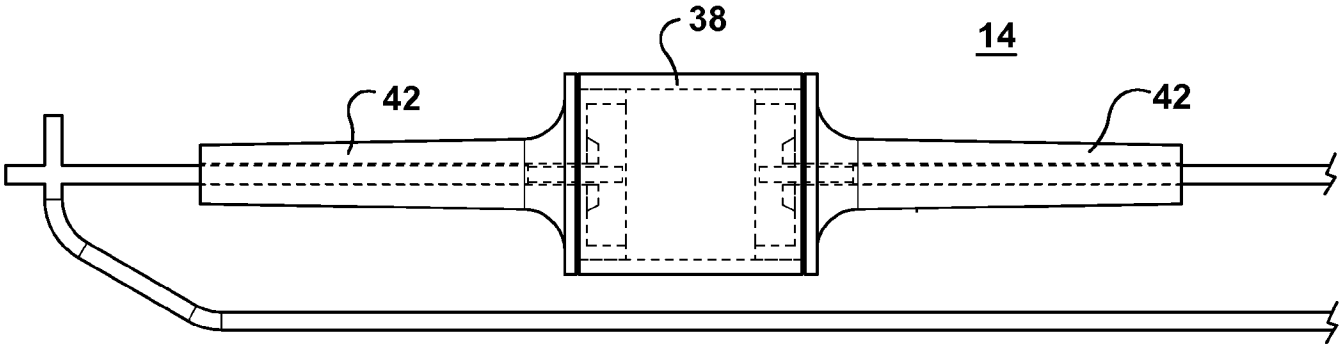
FIGS. 16 and 17 are views showing the simplified geometry of the arc tube and conductors used in electrostatic simulation results.
Figure 17:
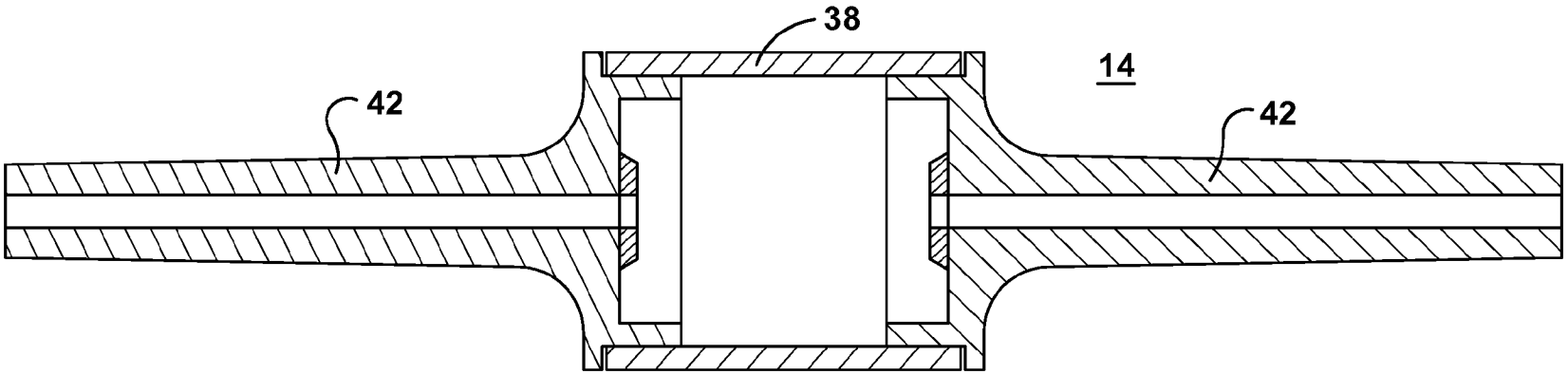

This example describes data produced for ceramic metal halide discharge lamps using software by Comsol Multiphysics 2010 developed with the University of Budapest for electrostatic calculation using finite element analysis. Inputs into the software were parameters describing the geometry of the arc tube of the 39 W lamp shown in FIGS. 16 and 17, material properties and an applied voltage of 1 kV. The arc tube and conductors shown in these figures was drawn to scale, the distance between the electrodes in the discharge region being 4.30 mm. The geometry was simplified for these calculations, such as by not using a coil on the electrode. The feedthrough conductors in the leg and the electrode in the discharge region were treated as being made of the same material. Finite elements analysis was used to calculate electric field based on these inputs.

Maxwell equations solved in the discharge geometry region by finite element analysis were as follows:

Gauss' law: $\nabla D=\rho$,

Electric potential: $E=-\nabla V$;

Constitutive relation: $D=\in_0\in_r E$, which above equations produce the following differential equation that was solved for V:

$$-\nabla(\in_0\in_r\nabla V)=0,$$

where V is the electric potential, $\in_0$ is the dielectric permittivity of a vacuum, $\in_r$ is dielectric permittivity of the material in the given modeling space, $\nabla$ is the directional derivative in the 3 directions of the Cartesian coordinate system $(\partial/\partial x)/(\partial/\partial y)/(\partial/\partial z)$, and $\rho$ is volume density of free charges.

The software ran the finite element analysis together with adaptive meshing using a variety of numerical solvers. The AC/DC module provides an environment for simulation of electromagnetic problems in 2 and 3 dimensions. The software used static modeling without moving charges. Electric field was measured using scalar values normalized at the tip of the powered electrode. The electrode proximal to the foil was treated as the powered electrode while the other electrode was at 0 potential. That unpowered electrode, the foil and the frame member were treated as grounded elements. The gas was given an $\in_r$ value of 1, the ceramic was given an $\in_r$ value of 10 and the vacuum space was given an $\in_r$ value of 1.

Figure 18A:
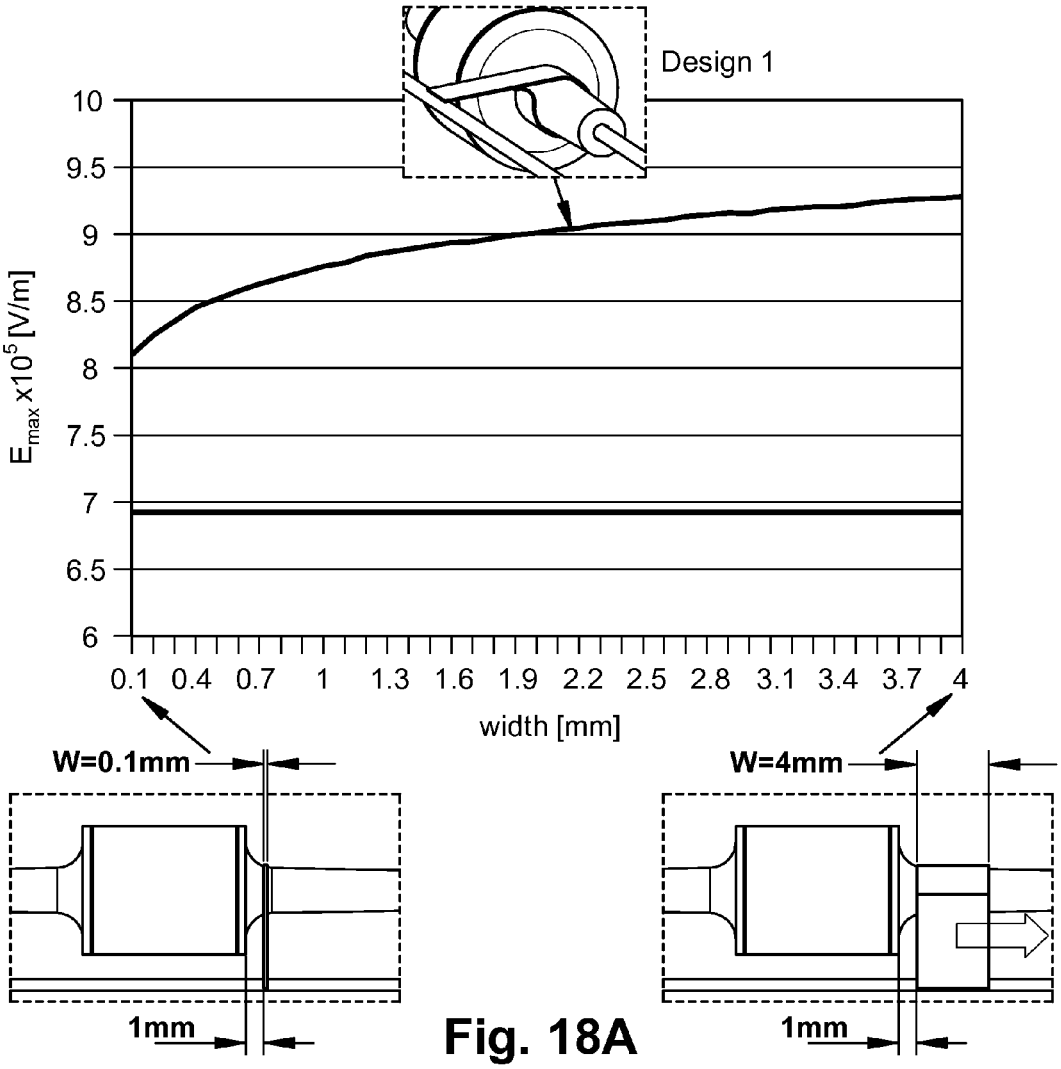
FIG. 18A is a figure showing electrostatic simulation results of Emax vs. foil width

Output of the software showing the effect of foil width on Emax was shown in FIG. 18A for 1) ceramic metal halide lamps having no foil (lower base line); 2) the ceramic metal halide lamp of Design 1 as shown in the figure having assymetric foil (made according to this disclosure) that encircles the arc tube leg in a closed loop for an angle of 340-350 degrees and has only one end portion of the foil welded to the frame member.

FIG. 18A shows that E max increases as foil width increases. The higher Emax is, the better the conditions are for igniting the lamp. Emax of the asymmetric foil is 22% higher than the baseline for the lamp without foil, at a foil width of 2 mm.

Figure 18B:
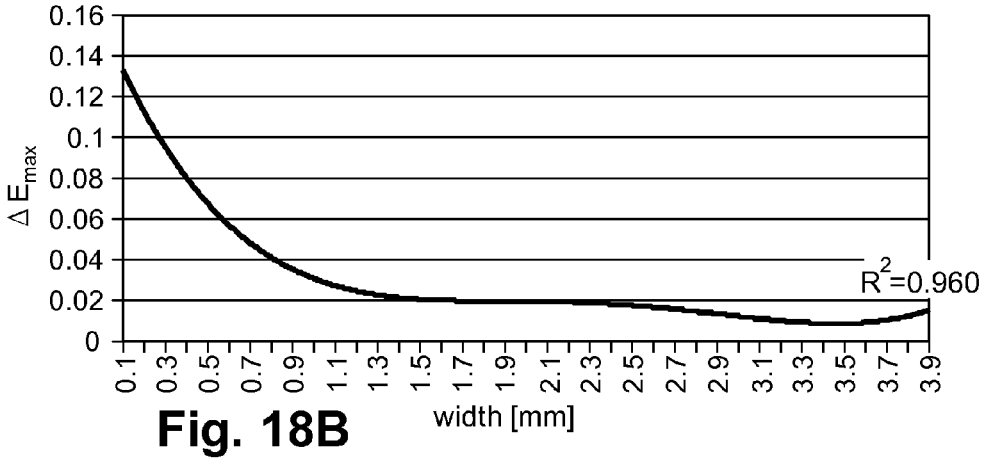
FIG. 18B is a figure based on FIG. 18A showing change in Emax vs. foil width.

FIG. 18B shows Emax change (y2−y1) versus foil width prepared using the data that generated FIG. 18A. The Emax change first stops at a width of about 1.5 mm. This figure indicates that a width of the foil is advantageously at least 1.0 mm, at least 1.5 mm, or more specifically, in a range of 1.0 mm to 4.0 mm, 1.0 to 3.0 mm or 1.0 to 2.0 mm. An upper limit of foil width is that the foil should not be so wide that it covers the portion of the arc tube leg where the sealing frit is located as this can crack the leg. Also, foils should not be so wide that they excessively cool the arc tube.

EXAMPLE 2

Figure 19:
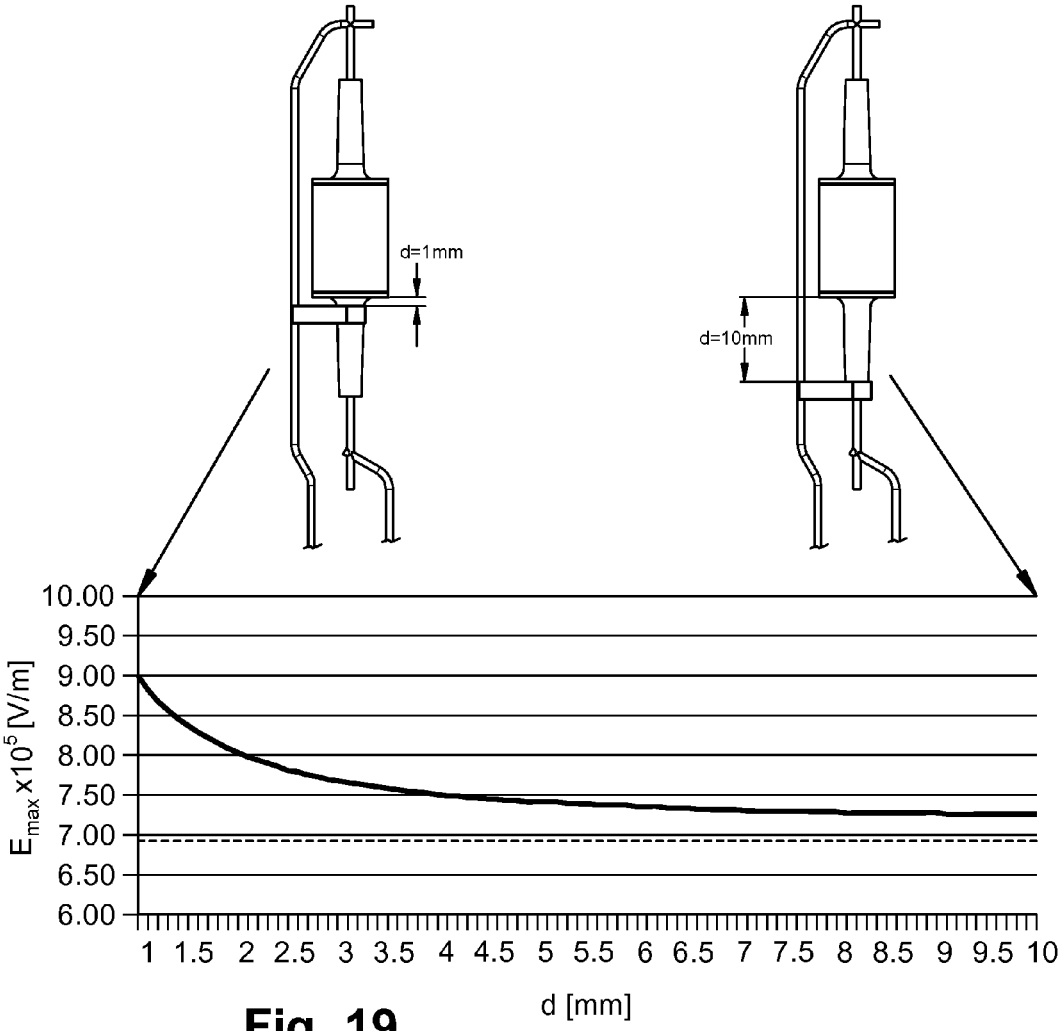
FIG. 19 is a figure showing electrostatic simulation results of Emax versus distance, d, away from the central body of the arc tube.

FIG. 19 was prepared using the same software and inputs described above with regard to Example 1, except that the distance, d, between the outer surface of the flange of the arc tube leg and the proximal edge of the foil was varied as shown in the drawings of the arc tube in this figure. This figure shows electrostatic simulation results of the effect of distance away from the central portion of the arc tube on E max for a ceramic discharge lamp with the arc tube of FIGS. 16 and 17 of foil Design 1 as shown in FIG. 18A. The foil width was 2 mm. The lower reference line shows that Emax is much lower (about $7.0\times10^5$ V/m) in the ceramic discharge lamp without foil. In addition, the figure shows that when the distance d is 1 mm, Emax is about $9\times10^5$ V/m, which is much higher than when d is 10 mm (under $7.5\times10^5$ V/m). The source of the charge is the powered electrode. Electric field will decrease away from the source of the charge. Thus, when the distance, d, between the powered electrode and the foil is increased, Emax decreases. The value d should be less than or equal to 8.00 mm, and more specifically, less than or equal to 2.00 mm. Emax should be at least $8\times10^5$ V/m, which is achieved when a value of d is less than or equal to 2.00 mm. As a minimum value, the proximal edge of the foil should not rest on a curved surface of the leg as this could cause cracking.

EXAMPLE 3

FIG. 20 was prepared using the same software and inputs described above with regard to Example 1, except that the angle by which the foil wraps around the arc tube leg was changed across a range of angles from 10 to 340 degrees. The distance d was 1.0 mm and the foil width was 2.0 mm. This figure shows that when encircling the arc tube leg by about 340 degrees, Emax is 28% higher than a lamp without a foil aid. Also, Emax is 18% higher at about a 340 degree foil wrapping angle compared to only a 10 degree foil wrapping angle. From this figure, the foil wrapping angle Phi is at least 270 degrees, in particular, at least 300 degrees, and more specifically at least 320 degrees, up to 360 degrees.

EXAMPLE 4

For all of the cold box measurements of this example, the requirements of ANSI:C78-389-2004-MOM were adhered to. Prior to cold box measurement, the lamps were aged for 30 minutes in position of measurement. If the lamps have been aged for regular photo interval on life test racks, there is no need to 30 minute aging, if the cold box is done first. Lamps were soaked for 6 hours at temperature in the cold box prior to measurement. Regarding lamp starting voltage requirements for lamps requiring auxiliary starting circuits, lamps shall start within the time specified at the ambient temperature indicated when the following sine wave open-circuit test voltages and a starting pulse at the minimum pulse characteristics described below are applied (Table 1). The characteristics are measured at the terminals of the lamp holder. The pulse is applied to the center terminal of the lamp base with the shell grounded.

TABLE 1

| Temperature | Minimum OCV RMS Volts | Minimum OCV Peak Volts | Probability of starting within 30 seconds |
|---|---|---|---|
| 10° C. | 254 | 359 | 98% for 0-hour lamps |
| −30° C. | 254 | 359 | 90% of 100-hour lamps |

Shown below are comparative testing for 39 watt ceramic metal halide lamps without foil and using argon and a higher level of $Kr^{85}$ or using the foil aid of this disclosure (Design 1 of FIG. 18A) and a lower level of $Kr^{85}$. The foil was 2 mm wide and was located at a distance, d, of 2.0 mm away from the flange of the arc tube leg. To produce Table 2, cold box testing per ANSI requirements subjected the lamps to ignition testing after maintaining the lamps at 10° C. for 6 hours after they had operated for 0 hours and at −30° C. for 6 hours after they had operated for 100 hours. An ignition pulse of 2.1 kV magnitude, and 4 microsecond width was applied. The terms 95% LCL and 95% UCL represent the % of the population of lamps that started at the corresponding lower and upper 95% confidence limits.

TABLE 2

| $Kr^{85}$ | Design | Hours | Temp. | 95% LCL | Median | 95% UCL |
|---|---|---|---|---|---|---|
| 6.2 MBq/l | No foil | 0 | 10 C. | 100 | 100 | 100 |
| 6.2 MBq/l | No foil | 100 | −30 C. | 100 | 100 | 100 |
| 0.16 MBq/l | Design 1 | 0 | 10 C. | 100 | 100 | 100 |
| 0.16 MBq/l | Design 1 | 100 | −30 C. | 100 | 100 | 100 |

It is seen that even with reduced $Kr^{85}$ levels, the lamps perform exactly as the lamps with the higher $Kr^{85}$ content. This would not be possible without the foil ignition aid of FIG. 18A.

The photometric results of this test shown below indicate that the foil did not have any deleterious effect on performance. LPW means lumens per watt; CCT means correlated color temperature and CRI means color rendering index.

TABLE 3

| Parameter | No foil (6.2 MBq/L $Kr^{85}$) Avg | No foil Sd | Design 1 (0.16 MBq/L $Kr^{85}$) Avg | Design 1 Sd | P value (comparing Design 1 with no Foil) |
|---|---|---|---|---|---|
| Volt | 86 | 2 | 86 | 1 | 0.900 |
| Lumens | 2235 | 65 | 2213 | 60 | 0.321 |
| LPW | 57 | 2 | 57 | 2 | 0.328 |
| CCT | 2876 | 32 | 2893 | 24 | 0.110 |
| CRI | 91 | 1 | 90 | 1 | 0.328 |

The p-value in the above table is a statistical measure of whether the two populations are equivalent or different. A p-value of >0.05 implies that statistically, the same parameter from the two populations are identical.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. A high intensity discharge lamp comprising:

an electrically insulating arc tube comprised of light transmissive material having a central portion and two legs each of which extends from said central portion, said central portion forming an interior discharge region;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees; and wherein said foil includes two end portions, and a central portion therebetween that encircles said arc tube leg, a first said end portion of said foil being connected to said frame member and a second said end portion of said foil being connected to said foil between said central portion and said first end portion of said foil.

2. The high intensity discharge lamp of claim 1 wherein said foil encircles said leg by said range of at least 300 degrees to 360 degrees.

3. The high intensity discharge lamp of claim 2 wherein said foil encircles said leg by said range of at least 320 degrees to 360 degrees.

4. The high intensity discharge lamp of claim 1 wherein there is no electrical conductor encircling an exterior surface of the other said arc tube leg.

5. The high intensity discharge lamp of claim 1 wherein there is no electrical conductor disposed on an exterior surface of said central portion of said arc tube.

6. The high intensity discharge lamp of claim 1 wherein a width of said foil ranges from 1 mm to 4 mm.

7. The high intensity discharge lamp of claim 1 wherein the width of said foil ranges from 1 mm to 3 mm.

8. The high intensity discharge lamp of claim 1 wherein the width of said foil ranges from 1 mm to 2 mm.

9. The high intensity discharge lamp of claim 1 wherein a thickness of said foil is less than 0.2 mm.

10. The high intensity discharge lamp of claim 9 wherein a thickness of said foil ranges from 0.01 mm to 0.15 mm.

11. The high intensity discharge lamp of claim 9 wherein a thickness of said foil ranges from 0.01 mm to 0.08 mm.

12. The high intensity discharge lamp of claim 1 wherein each of said legs includes a flange and a boss extending from said flange into said discharge region so that said flange abuts said central portion.

13. A high intensity discharge lamp comprising:

an electrically insulating arc tube comprised of light transmissive material having a central portion and two legs each of which extends from said central portion, said central portion forming an interior discharge region, wherein each of said legs includes a flange and a boss extending from said flange into said discharge region so that said flange abuts said central portion;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees; and wherein said foil includes two end portions, and a central portion therebetween that encircles said arc tube leg, a first said end portion of said foil being connected to said frame member and a second said end portion of said foil being connected to said foil between said central portion and said first end portion of said foil;

wherein a distance from an outer surface of said flange to a proximal edge of said foil is not more than 8 mm.

14. A high intensity discharge lamp comprising:

an electrically insulating arc tube comprised of light transmissive material having a central portion and two legs each of which extends from said central portion, said central portion forming an interior discharge region, wherein each of said legs includes a flange and a boss extending from said flange into said discharge region so that said flange abuts said central portion;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees; and wherein said foil includes two end portions, and a central portion therebetween that encircles said arc tube leg, a first said end portion of said foil being connected to said frame member and a second said end portion of said foil being connected to said foil between said central portion and said first end portion of said foil; wherein a distance from an outer surface of said flange to a proximal edge of said foil is not more than 2 mm.

15. The high intensity discharge lamp of claim 1 wherein said arc tube comprises polycrystalline alumina.

16. A high intensity discharge lamp comprising:

an electrically insulating arc tube comprised of light transmissive material having a central portion and two legs each of which extends from said central portion, said central portion forming an interior discharge region, wherein said discharge region comprises inert gas, krypton gas and a dose of mercury and metal halides, wherein a mixture of argon gas and $Kr^{85}$ gas present in the discharge region has an activity concentration of not greater than 0.16 MBq/liter;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees; and wherein said foil includes two end portions, and a central portion therebetween that encircles said arc tube leg, a first said end portion of said foil being connected to said frame member and a second said end portion of said foil being connected to said foil between said central portion and said first end portion of said foil.

17. The high intensity discharge lamp of claim 1 wherein said electrical conductors include a first conductor to which voltage is applied and a second conductor, wherein said frame member is electrically connected to said second conductor and said foil is wrapped around said leg but electrically insulated from said first electrical conductor.

18. The high intensity discharge lamp of claim 1 wherein a ratio of a width of said foil to a thickness of said foil ranges from 6.6:1 to 400:1.

19. The high intensity discharge lamp of claim 1 wherein said first end portion of said foil is connected to said frame member and said second end portion of said foil is connected to said foil, by welding.

20. The high intensity discharge lamp of claim 1 wherein said foil is comprised of a base metal selected from the group consisting of Nb, Mo, Ta, Pt, Re, W, Ni, and combinations thereof, and a combination of any of said base metals with cladding comprised of one or more of said base metals.

21. A high intensity discharge lamp comprising:

an electrically insulating arc tube comprised of light transmissive material having a central portion and two legs each of which extends from said central portion, said central portion forming an interior discharge region, wherein each of said legs includes a flange and a boss extending from said flange into said discharge region so that said flange abuts said central portion;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees;

wherein a distance from an outer surface of said flange to a proximal edge of said foil ranges from 1.5 to 8 mm.

22. The high intensity discharge lamp of claim 21 wherein a thickness of said foil ranges from 0.01 mm to 0.15 mm.

23. The high intensity discharge lamp of claim 21 wherein a width of said foil ranges from 1 mm to 4 mm.

24. The high intensity discharge lamp of claim 21 wherein a mixture of argon gas and $Kr^{85}$ gas present in the discharge region has an activity concentration of not greater than 0.16 MBq/liter.

25. A high intensity discharge lamp comprising:

an electrically insulating arc tube comprised of light transmissive material having a central portion and two legs each of which extends from said central portion, said central portion forming an interior discharge region;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees;

wherein a width of said foil ranges from 1 mm to 4 mm;

wherein each of said legs includes a flange and a boss extending from said flange into said discharge region so that said flange abuts said central portion, wherein a distance from an outer surface of said flange to a proximal edge of said foil ranges from 1.5 to 8 mm.

26. The high intensity discharge lamp of claim 25 wherein a thickness of said foil ranges from 0.01 mm to 0.15 mm.

27. A high intensity discharge lamp comprising:

an electrically insulating arc tube comprised of light transmissive material having a central portion and two legs each of which extends from said central portion, said central portion forming an interior discharge region, wherein a mixture of argon gas and $Kr^{85}$ gas present in the discharge region has an activity concentration of not greater than 0.16 MBq/liter;

electrical conductors each extending through one of said legs and being spaced apart from each other in said discharge region;

a sealed shroud comprised of light transmissive material enclosing said arc tube and electrical connection to said electrical conductors through said sealed shroud;

an electrically conductive frame member disposed in an interior of said shroud that is electrically connected to one of said electrical conductors;

an ignition aid comprising electrically conductive foil that is fastened to said frame member and forms a closed loop that encircles one of said legs of said arc tube around one of said electrical conductors, wherein said foil encircles said leg by a range of at least 270 degrees to 360 degrees;

wherein a width of said foil ranges from 1 mm to 4 mm.

28. The high intensity discharge lamp of claim 1 wherein said foil encircles said leg so that said foil is in contact with said leg by said range of at least 270 degrees to 360 degrees and has a width ranging from 1 mm to 4 mm, said second said end portion of said foil being connected by a weld to said foil between said arc tube leg and said first end portion of said foil.

29. The high intensity discharge lamp of claim 28 wherein said foil encircles said leg so that said foil is in contact with said leg by 320 degrees to 360 degrees.

30. The high intensity discharge lamp of claim 29 wherein said foil encircles said leg so that said foil is in contact with said leg by 355 degrees to 360 degrees.

31. The high intensity discharge lamp of claim 1 wherein said foil encircles said leg so that said foil is in contact with said leg by 355 degrees to 360 degrees.

* * * * *